US011081306B2

(12) United States Patent
Li et al.

(10) Patent No.: US 11,081,306 B2
(45) Date of Patent: Aug. 3, 2021

(54) PROCESS OF MANUFACTURING HEAT RESISTANT AND LOW CARBON PLATE FOR CIRCUIT BREAKER

(71) Applicant: Shihlin Electric & Engineering Corp., Taipei (TW)

(72) Inventors: Chih-Yi Li, Taipei (TW); Hsiao-Ping Fang, Taipei (TW); Hung-Chieh Chen, Taipei (TW)

(73) Assignee: SHIHLIN ELECTRIC & ENGINEERING CORP., Taipei (TW)

( * ) Notice: Subject to any disclaimer, the term of this patent is extended or adjusted under 35 U.S.C. 154(b) by 168 days.

(21) Appl. No.: 16/370,727

(22) Filed: Mar. 29, 2019

(65) Prior Publication Data

US 2020/0312598 A1 Oct. 1, 2020

(51) Int. Cl.

| | |
|---|---|
| ***H01H 11/00*** | (2006.01) |
| ***H01H 65/00*** | (2006.01) |
| ***H01H 69/00*** | (2006.01) |
| ***H01H 71/02*** | (2006.01) |

(52) U.S. Cl.
CPC ..... *H01H 69/00* (2013.01); *H01H 71/0264* (2013.01); *H01H 2229/05* (2013.01)

(58) Field of Classification Search
CPC .. H01H 69/00; H01H 71/026; H01H 2229/05; Y10T 29/49105; Y10T 29/49224
USPC ..... 29/622, 885
See application file for complete search history.

(56) References Cited

U.S. PATENT DOCUMENTS

| | | | | |
|---|---|---|---|---|
| 2,582,744 A * | 1/1952 | Brennan | ..... | C23C 4/14 29/885 |
| 5,911,899 A * | 6/1999 | Yoshikai | ..... | H05B 3/86 219/522 |
| 8,296,943 B2 * | 10/2012 | Smith | ..... | H01G 4/18 29/846 |

* cited by examiner

*Primary Examiner* — Donghai D Nguyen
(74) *Attorney, Agent, or Firm* — Muncy, Geissler, Olds and Lowe, P.C.

(57) ABSTRACT

A process of manufacturing a heat resistant and low carbon plate for a circuit breaker includes preparing a heat resistant and low carbon plate for a circuit breaker; coating the heat resistant and low carbon plate with organic material; coating the organic material with inorganic material; and heating and drying the heat resistant and low carbon plate. The process continuously grips each of heat resistant and low carbon plates conveyed on a conveyor with a coat application device being used for the coating steps. A circuit breaker having the heat resistant and low carbon plate is also provided.

4 Claims, 3 Drawing Sheets

PROCESS OF MANUFACTURING HEAT RESISTANT AND LOW CARBON PLATE FOR CIRCUIT BREAKER

BACKGROUND OF THE INVENTION

1. Field of the Invention

The invention relates to process of circuit breakers and more particularly to a process of manufacturing a heat resistant and low carbon plate for a circuit breaker and the circuit breaker having the heat resistant and low carbon plate.

2. Description of Related Art

Conventionally, a circuit breaker is an automatically operated electrical switch designed to protect an electrical circuit from damage caused by excess current from an overload or short circuit. Its basic function is to interrupt current flow after a fault is detected. A circuit breaker can be reset either manually or automatically to resume normal operation.

The circuit breaker contacts must carry the load current without excessive heating, and must also withstand the heat of the arc produced when interrupting (i.e., opening) the circuit. When a high current or voltage is interrupted, an arc is generated at the contact. The high heat may leave carbon residue on the contact and wear the arc extinguishing member, thereby malfunctioning the circuit breaker.

Conventionally, heat generated by the arc may cause a board made of organic material to expand air. And in turn, the air flows through the arc extinguishing chamber to extinguish the arc, thereby protecting the circuit breaker.

However, the organic material does not withstand high heat and carbon may be generated to deposit on the contacts. Thus, the circuit breaker may be malfunctioned. It is found that the conventional circuit breakers have the following drawbacks: Low resistance to heat. Non-continuous air expansion. Generation of carbon residue. Primer is required. No application device. No positioning member for sequential manufacturing steps.

Thus, the need for improvement still exists.

SUMMARY OF THE INVENTION

It is therefore one object of the invention to provide a process of manufacturing a heat resistant and low carbon plate for a circuit breaker and the circuit breaker having the heat resistant and low carbon plate in which the heat resistant and low carbon plate is initially coated with organic material and inorganic material is further applied on the layer of organic material of heat resistant and low carbon plate so that after the organic and inorganic materials are secured together, the circuit breaker is capable of withstanding high heat with low carbon residue left on the heat resistant and low carbon plate.

It is another object of the invention to provide a process of manufacturing a heat resistant and low carbon plate for a circuit breaker and the circuit breaker having the heat resistant and low carbon plate.

In a first aspect of the invention, there is provided a process of manufacturing a heat resistant and low carbon plate for a circuit breaker, comprising preparing a heat resistant and low carbon plate for a circuit breaker; coating the heat resistant and low carbon plate with organic material; coating the organic material with inorganic material; and heating the heat resistant and low carbon plate.

Preferably, a robotic arm is used to grip a heat resistant and low carbon plate and position same on the positioning member. The conveyor moves forward. A coat application device is used to coat the layer of organic material of the heat resistant and low carbon plate with inorganic material.

Preferably, 25-75 ml of modified polysiloxane is added to the inorganic material.

Preferably, the heat resistant and low carbon plates are gripped by a robotic arm sequentially with coating and heating being performed thereafter on the conveyor.

Preferably, on the heat resistant and low carbon plate, the inorganic material is secured onto the organic material by heating.

Preferably, in the heating a chemical reaction occurs between the inorganic material and the organic material.

Preferably, heating temperatures are different and the heating a two-stage heating.

Preferably, the heating and drying is a two-stage heating and drying, and in a first stage heating is at 100-120° C. for 30 minutes and in a second stage heating is at 180-200° C. for 30 minutes so that the inorganic material can be cured completely.

Preferably, both the organic material and the inorganic material are coated by means of spray coating or manual coating.

Preferably, the organic material includes polyamide and polyester (PE), and the inorganic material includes modified polysiloxane.

In a second aspect of the invention, there is provided a circuit breaker comprising a heat resistant and low carbon plate including a layer of organic material formed thereon and a layer of inorganic material formed on the layer of organic material.

The invention has the following advantages and benefits in comparison with the conventional art:

The plate is heat resistant and has low carbon residue after being subject to high heat. Thus, the heat resistant and low carbon plates can prevent the circuit breaker from being broken.

The heat resistant and low carbon plates do not change appearance of the circuit breaker. The organic material coated with the inorganic material provides a double layer protection to the circuit breaker so that the circuit breaker is heat resistant and have low carbon residue being generated after being subject to high heat.

The circuit breaker can withstand high heat. Otherwise, it may be broken. Low carbon residue is generated due to the novel manufacturing process.

It has double layer protection and can continuously generate air current to extinguish arc.

Arc is substantially extinguished. Also, minimum carbon residue is generated on the contacts of the circuit breaker. Otherwise, short circuit may occur.

No appearance change. Transparent coating. Decreased number of the manufacturing steps. Primer is not required. All coating steps are done in one process. The inorganic material and the organic material are secured together.

The manufacturing process is continuous with maximum yield.

The above and other objects, features and advantages of the invention will become apparent from the following detailed description taken with the accompanying drawings.

DETAILED DESCRIPTION OF THE INVENTION

Figure 1:
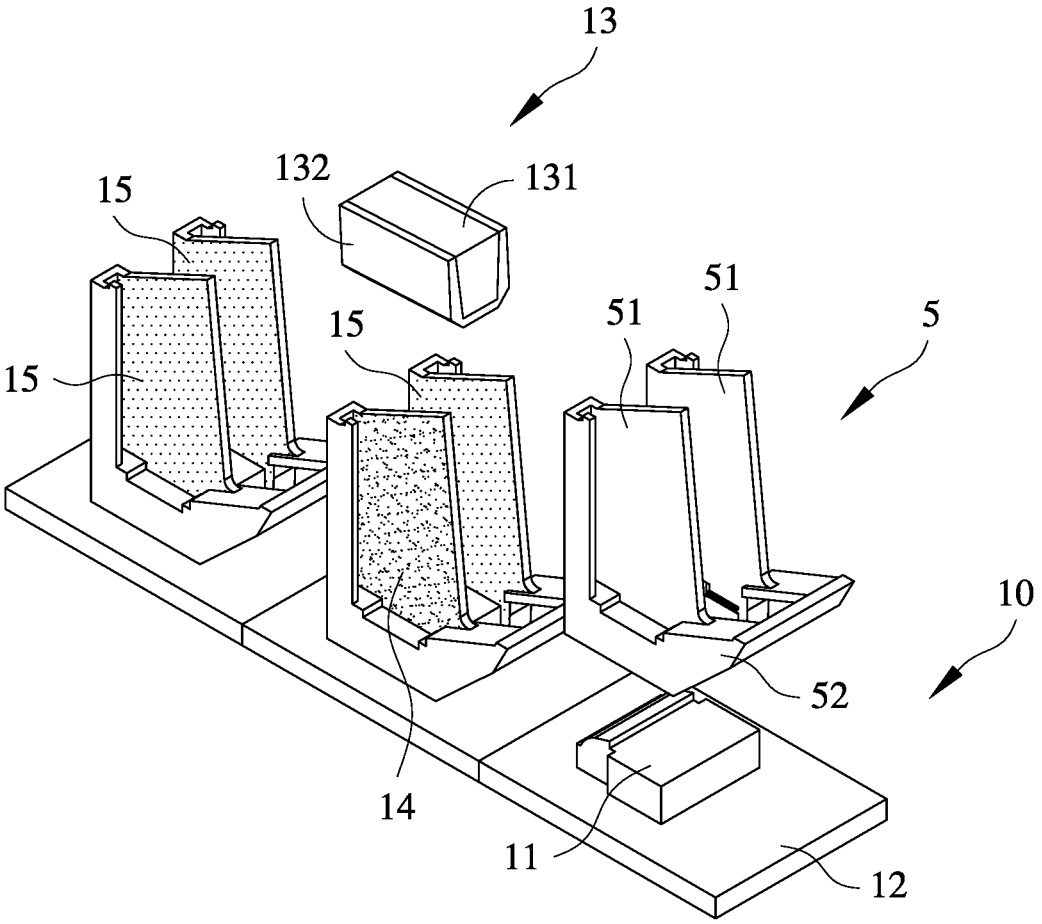
FIG. 1 is an exploded perspective view showing a process of manufacturing a heat resistant and low carbon plate for a circuit breaker according to the invention.

Referring to FIG. 1, a conveyor 10 of the invention includes a positioning member 11 and a base 12. A robotic arm (not shown) is used to grip a heat resistant and low carbon plate 5 and position same on the positioning member 11. The conveyor 10 moves forward. A coat application device 13 includes a main body 131 and a cushion layer 132 formed on the main body 131. The coat application device 13 is used to coat a layer of organic material 14 of the heat resistant and low carbon plate 5 with inorganic material 15. The inorganic material 15 is heated in two stages prior to sending the heat resistant and low carbon plate 5 to an oven (not shown) for drying by heating.

A process of manufacturing the heat resistant and low carbon plate 5 for a circuit breaker in accordance with the invention comprises the steps of preparing a heat resistant and low carbon plate 5; coating the heat resistant and low carbon plate 5 with organic material 14; coating the organic material 14 with inorganic material 15; and heating and drying the heat resistant and low carbon plate 5 to secure the inorganic material 15 onto the organic material 14.

The organic material 14 includes polyamide and polyester (PE). 25-75 ml of modified polysiloxane is added to the inorganic material 15. After coating the organic material 14 with the inorganic material 15 by means of the coat application device 13, the heat resistant and low carbon plate 5 is sent to an oven for drying by heating. The heating is a two-stage one. For example, the heat resistant and low carbon plates 5 are gripped by the robotic arm sequentially with coating and heating being performed thereafter on the conveyor 10.

On the heat resistant and low carbon plate 5, the inorganic material 15 is secured onto the organic material 14 by heating in which a chemical reaction occurs between the inorganic material 15 and the organic material 14. Heating temperatures are different. For example, in a first stage heating temperate is 100-120° C. and heating lasts for 30 minutes and in a second stage heating temperature is 180-200° C. ad heating lasts for 30 minutes.

Both the organic material 14 and the inorganic material 15 are coated by means of spray coating or manual coating.

A circuit breaker has the heat resistant and low carbon plate 5 coated with an organic material 14 which is in turn coated with an inorganic material 15. The heat resistant and low carbon plate 5 includes two parallel side walls 51 and a base member 52 interconnecting the side walls 51.

Figure 2:
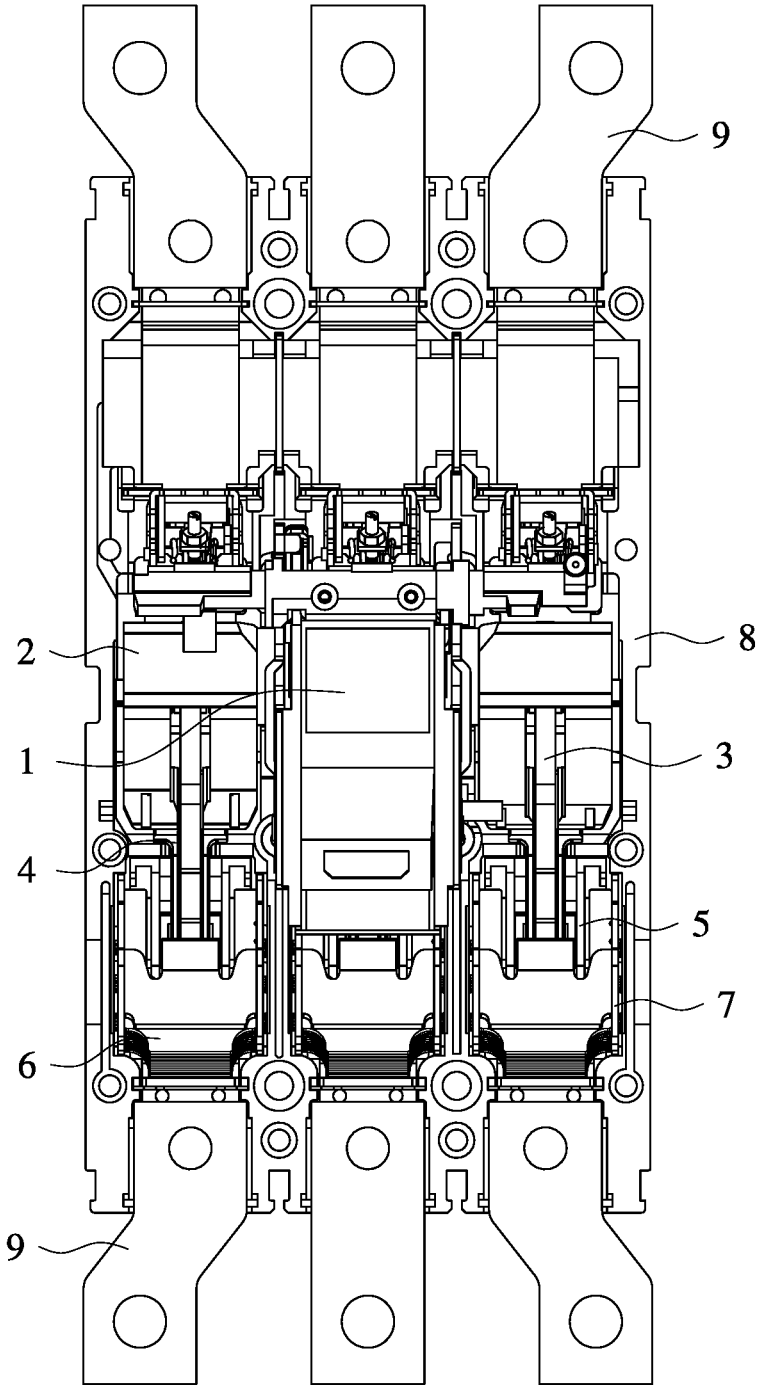
FIG. 2 is a top view of the circuit breaker incorporating the heat resistant and low carbon plate.
Figure 3:
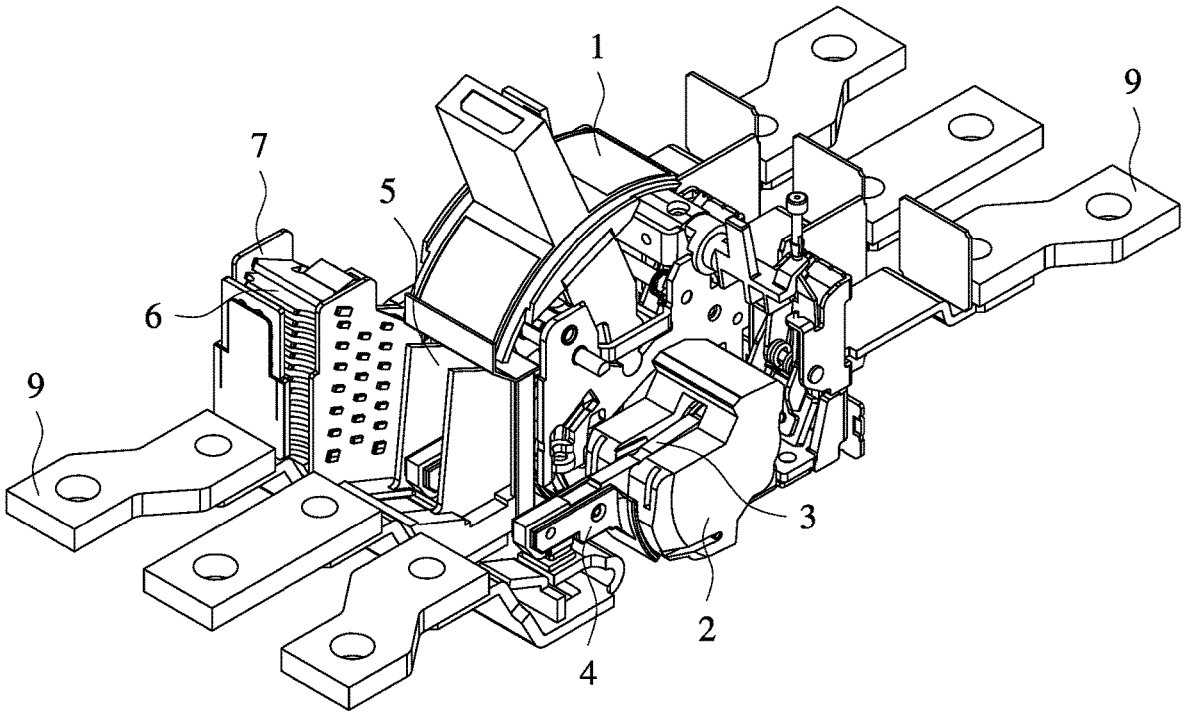
FIG. 3 is a perspective view of the circuit breaker incorporating the heat resistant and low carbon plate.

Referring to FIGS. 2 and 3, the circuit breaker includes a lever 1, a link 2, a moveable member 3, a guard 4, a heat resistant and low carbon plate 5, a plurality of grids 6, two side members 7, a base board 8, and a plurality of contacts 9. An arc extinguishing chamber consists of the grids 6 and the side members 7. All of the lever 1, the link 2, the moveable member 3, the guard 4, the heat resistant and low carbon plate 5, the grids 6, the side members 7, the base board 8, and the contacts 9 are well known devices and thus a detailed description thereof is omitted herein for the sake of brevity.

The invention has the following characteristics and advantages:

The plate is heat resistant and has low carbon residue after being subject to high heat. Thus, the heat resistant and low carbon plates can prevent the circuit breaker from being broken.

The heat resistant and low carbon plate does not change appearance of the circuit breaker. The organic material coated with the inorganic material provides a double layer protection to the circuit breaker so that the circuit breaker is heat resistant and have low carbon residue being generated after being subject to high heat.

The circuit breaker can withstand high heat. Otherwise, it may be broken. Low carbon residue is generated due to the novel manufacturing process.

It has double layer protection and can continuously generate air current to extinguish arc.

Arc is substantially extinguished. Also, minimum carbon residue is generated on the contacts of the circuit breaker. Otherwise, short circuit may occur.

No appearance change. Transparent coating. Decreased number of the manufacturing steps. Primer is not required. All coating steps are done in one process. The inorganic material and the organic material are secured together.

The manufacturing process is continuous with maximum yield.

While the invention has been described in terms of preferred embodiments, those skilled in the art will recognize that the invention can be practiced with modifications within the spirit and scope of the appended claims.

What is claimed is:

1. A process of manufacturing a heat resistant and low carbon plate for a circuit breaker, comprising:

(1) preparing a heat resistant and low carbon plate for a circuit breaker;

(2) coating the heat resistant and low carbon plate with organic material;

(3) coating the coated organic material with inorganic material; and (4) heating and drying the double coated heat resistant and low carbon plate;

wherein the organic material includes polyamide and polyester (PE), and wherein 25-75 ml of modified polysiloxane is added to the inorganic material.

2. The process of claim 1, wherein step (4) is a two-stage heating and drying.

3. The process of claim 1, wherein step (4) is a two-stage heating and drying, and wherein in a first stage heating temperature is 100-120° C. and lasts for 30 minutes and in a second stage heating temperature is 180-200° C. and lasts for 30 minutes.

4. The process of claim 1, wherein both the organic material and the inorganic material are coated by means of spray coating or manual coating.

* * * * *